US006099710A

United States Patent [19]

Mou

[11] Patent Number: 6,099,710

[45] Date of Patent: Aug. 8, 2000

[54] METHOD OF CONTROLLING EXCESSIVE ELECTROFORMING PORTION OF AN OSCILLATING PLATE

[75] Inventor: Michael Mou, Tu-Cheng, Taiwan

[73] Assignee: DBTEL Incorporated, Taipei Hsien, Taiwan

[21] Appl. No.: 09/184,440

[22] Filed: Nov. 2, 1998

[51] Int. Cl.[7] ..... C25D 1/00

[52] U.S. Cl. ..... 205/67; 205/170

[58] Field of Search ..... 205/67, 75, 78, 205/170

[56] References Cited

U.S. PATENT DOCUMENTS 5,326,454 7/1994 Engelhaupt ..... 205/67

5,622,611 4/1997 Marks et al. ..... 205/67

*Primary Examiner*—Kathryn Gorgos
*Assistant Examiner*—William T. Leader
*Attorney, Agent, or Firm*—Rosenberg, Klein & Lee

[57] ABSTRACT

A method of controlling excessive electroforming portion of an oscillating plate for an ink-jet printer includes steps of supplying a direct current power to electroform a first layer for a first time period, supplying an alternating current power to electroform a second layer on the first layer for a second time period to form an oscillating layer, coating the second layer with a photoresistive agent at positions where no projection is to be formed and supplying the alternating current power to electroform for a third time period so as to form desired projections on the second layer, whereby no excessive electroforming portion will be formed on the projections.

8 Claims, 4 Drawing Sheets

METHOD OF CONTROLLING EXCESSIVE ELECTROFORMING PORTION OF AN OSCILLATING PLATE

BACKGROUND OF THE INVENTION

1. Field of the Invention

This invention is related to a method of controlling excessive electroforming portion of an oscillating plate and in particular to one which applies direct current and alternating current electroforming process to eliminate excessive electroforming portion on the projection of the oscillating plate.

2. Description of the Prior Art

Ink-jet printers generally fall into two categories, i.e. the bubble type ink-jet printers and piezoelectric ink-jet printers. However, what the manufacture concerns most for piezoelectric ink-jet printers is related to the oscillating plate beside the ink cabin.

The working principle of ejecting ink from the piezoelectric print head will now be described hereinafter. Referring to FIG. 1, ink is first filled into the ink cabin 15 and then a ceramic piezoelectric actuator 12 is used for pushing the projection 14 on the oscillating plate 13 to squeeze ink out of the ink cabin 15 through nozzles 11. The print head generally includes a plurality of nozzles. The number of nozzles depends on the resolution of the printer. That is, if the printer has a higher resolution, its print head will have more nozzles.

Referring to FIG. 2, the oscillating plate 13 and the projection 14 are made of nickel by electroforming. A thin layer is first made by electroforming for 4 minutes to be used as the oscillating plate 13. Then, the area 19 is coated with a light interrupting agent for preventing current from flowing therethrough. Finally, the area 18 is electroformed for 25–40 minutes to form a projection 14.

Referring to FIG. 3, the conventional electroforming process utilizes direct current with a voltage of −4.5 volts. The current for the electroforming process is continuous and so the electroforming process will keep on until the power is turned off. Such an electroforming process is fast and fit for forming an object with large area or volume such as oscillating plate, but unsuitable for forming smaller object such as the projection.

Referring to FIG. 4, since the conventional electroforming process utilizes continuous direct current, it is very difficult to control the shape of the projection 14 and an excessive electroforming portion 141 will be formed on the projection 14. The excessive electroforming portion 141 will influence the resolution of the print head and so it is preferable to have a projection 14 with sharp edges. In other words, the removal of the excessive electroforming portion 141 will be helpful for the space arrangement design of the actuator and facilitate the alignment between the actuator and the projection.

The ink-jet printers with low resolution does not have a compact structure and so the existance of the excessive electroforming portion 141 is acceptable. However, the execessive portion 141 will limit the space arrangement design of the actuator and influence the accuracy in aligning the actuator with the projection, thereby causing a problem in manufacture and seriously influence the product quality.

Therefore, it is an object of the present invention to provide a method of controlling excessive electroforming portion on the projection of the oscillating plate, which can obviate and mitigate the above-mentioned drawbacks.

SUMMARY OF THE INVENTION

This invention is related to a method of controlling excessive electroforming portion of an oscillating plate and in particular to one which applies direct current and alternating current electroforming process to eliminate excessive electroforming portion on the projection of the oscillating plate.

A method of controlling excessive electroforming portion of an oscillating plate for an ink-jet printer according to the present invention includes steps of supplying a direct current power to electroform a first layer for a first time period, supplying an alternating current power to electroform a second layer on the first layer for a second time period to form an oscillating layer, coating the second layer with a photoresistive agent at positions where no projection is to be formed and supplying the alternating current power to electroform for a third time period so as to form desired projections on the second layer, whereby no excessive electroforming portion will be formed on the projections.

According to the present invention, the direct current power has a voltage of −4.5 volts, the first time period is 1 minute, the second time period is 3 minutes, the third time period is 25–40 minutes, and the alternating current are square waves with an amplitude of ±4.5 volts.

According to the present invention, the square waves have an electroforming term at −4.5 volts for 90 ms and an electrolyzing term at +4.5 volts for 300–600 ms. The oscillating plate is made of nickel.

DETAILED DESCRIPTION OF THE PREFERRED EMBODIMENT

Figure 1:
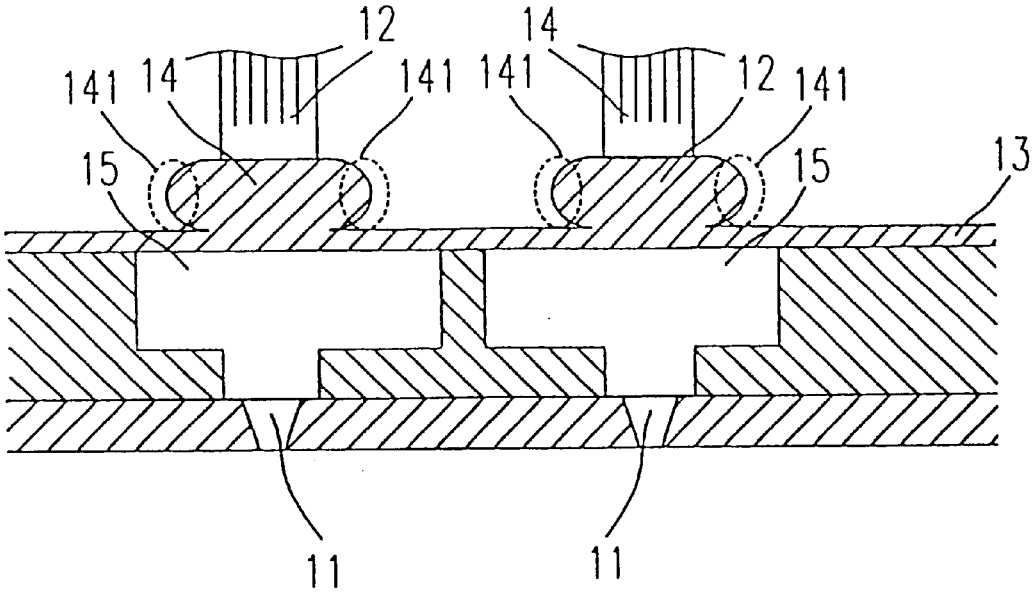
PRIOR ART FIG. 1
FIG. 1 is a sectional view of the print head of a prior art piezoelectric printer.
Figure 2:
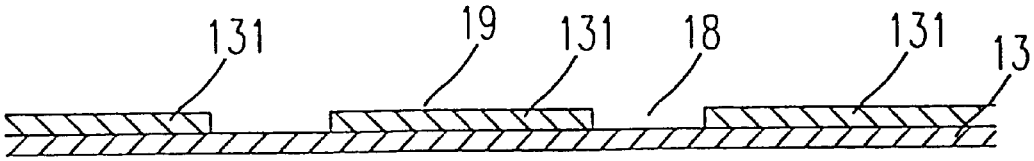
PRIOR ART FIG. 2
FIG. 2 illustrates a prior art oscillating plate coated with photoresistive agent.
Figure 3:
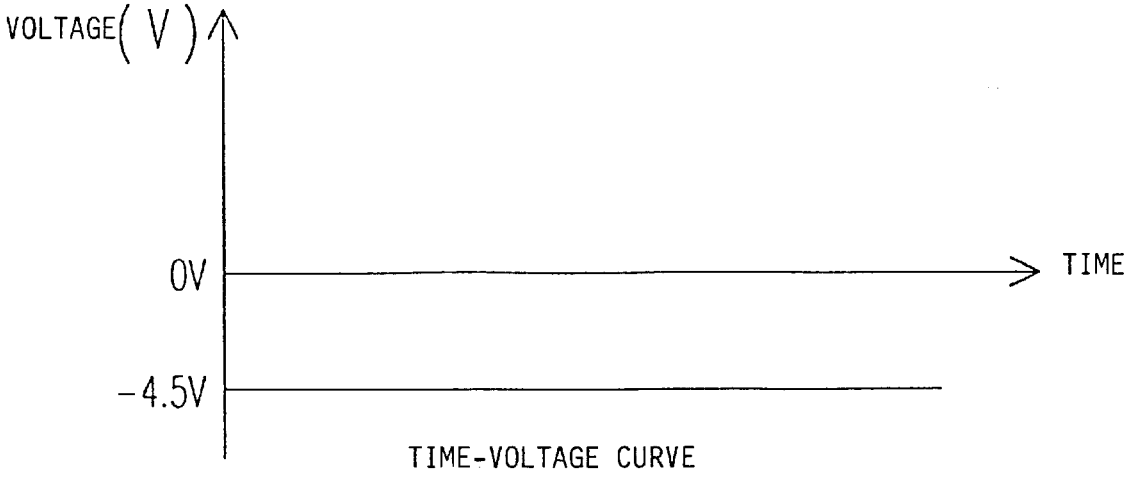
PRIOR ART FIG. 3
FIG. 3 illustrates the time-voltage curve of the conventional direct current electroforming process.
Figure 4:
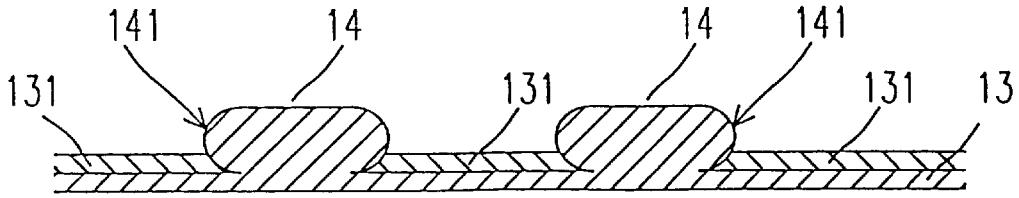
PRIOR ART FIG. 4
FIG. 4 illustrates the excessive electroforming portion formed on the projection.
Figure 5:
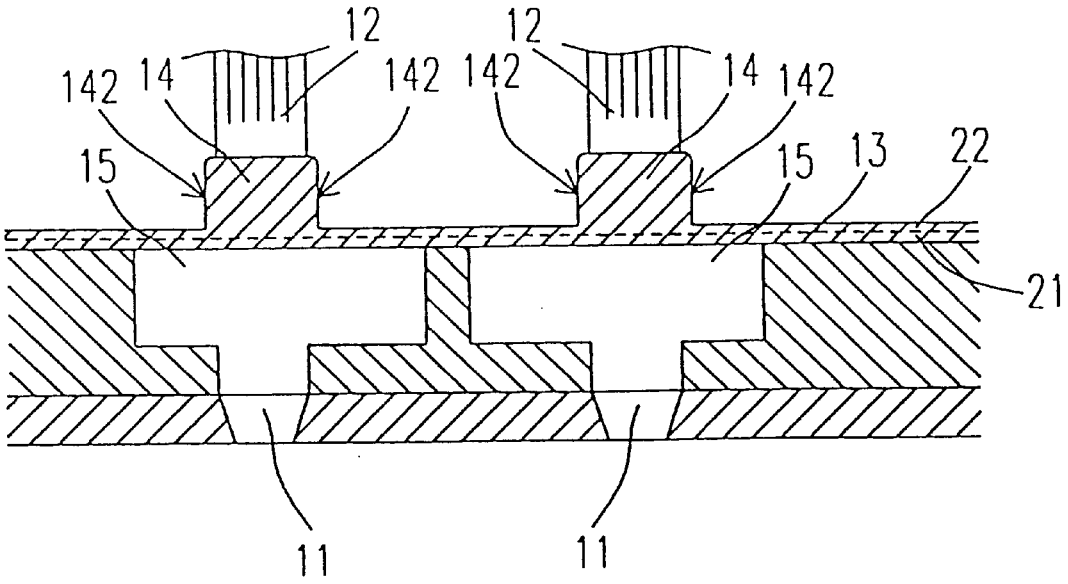
FIG. 5 is a sectional view of the print head of a piezoelectric printer according to the present invention.

With reference to the drawings and in particular to FIG. 5 thereof, the ideal edge 142 of the projection 41 should not have the excessive electroforming portion 141 shown in FIG. 1. Hence, in order to reduce the excessive electroforming portion during the manufacture of the projection 14, a direct current of −4.5 volts is first applied in the electroforming process for 1 minute to obtain a first layer 21. Then, the thin layer 21 is electroformed with a pulse power supply for 3 minutes to form a second layer 22 thereby forming an oscillating plate 13.

Figure 6:
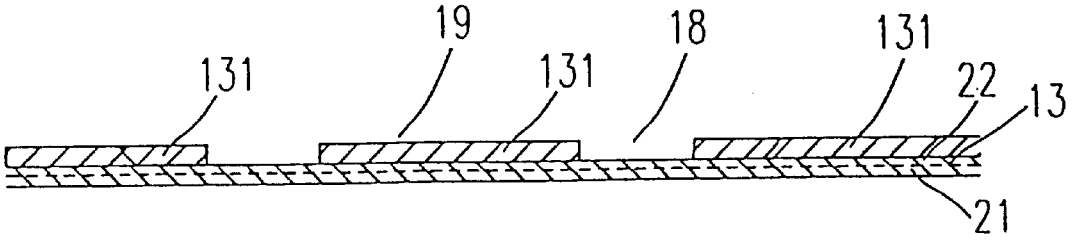
FIG. 6 illustrates the coating of photoresistive agent on the oscillating plate according to the present invention.

Thereafter, the oscillating plate 13 is coated with a photoresistive agent 131 according to the pattern of the projection so as to prevent current to pass therethrough (see FIG. 6). The oscillating plate 13 without photoresistive agent 131 will be formed with projections 14 in the electroforming process.

Figure 7:
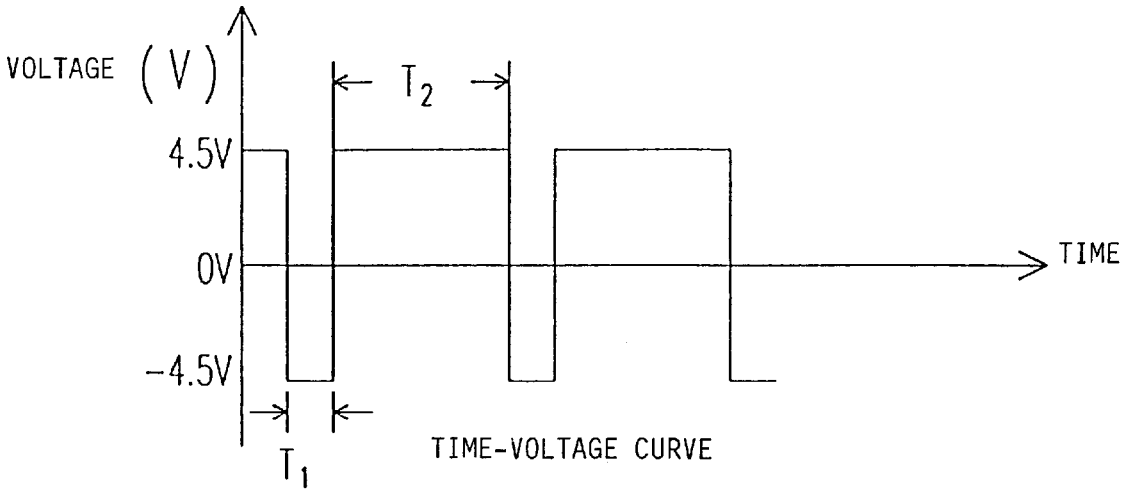
FIG. 7 illustrates the time-voltage curve of the alternating current electroforming process according to the present invention.

Referring to FIG. 7, the oscillating plate 13 is further electroformed with a square wave alternating current power supply for 25–40 minutes to form projections 14. Each period of the square wave alternating current has an electroforming term T1 at a negative voltage and an electrolyzing term T2 at a positive voltage. As the point of the positive pole will be first electrolyzed, the size of the excessive electroforming portion will be reduced thereby achieving the purpose of controlling the shape and size of the projections 14.

Figure 8:
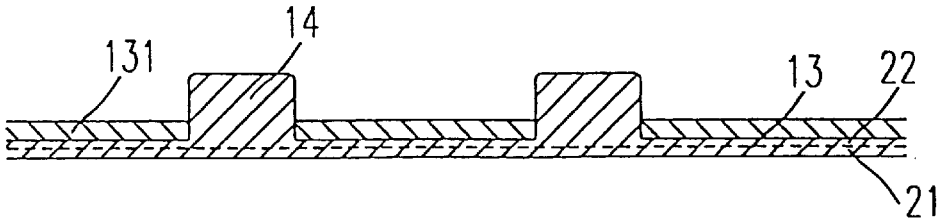
FIG. 8 illustrates the projection produced by the method according to the present invention.

Further, the edge 142 of the projection 14 can be modified during the electrolyzing term of the square wave to have a shape as shown in FIG. 8.

As it is easier to use square wave electroforming to control the shape, there will be no excessive electroforming portion on the projection. Accordingly, the resolution of the print head will not be influenced by the excessive electroforming portion and the space arrangement design of the actuator and the alignment between the actuator and the projection can be facilitated, thereby increasing the production rate.

The square wave has an amplitude of +4.5 volts, wherein the −4.5 volts provides an electroforming term T1 for 90 ms, and +4.5 volts an electrolyzing term T2 for 300–600 ms. The values of T1, T2 and amplitude may be changed as required.

Accordingly, the present invention differs from the prior art in utilizing different working voltages to eliminate excessive electroforming portions so as to increase the resolution and production rate.

In conclusion, the present invention first utilizes direct current electroforming and then alternating current electroforming to control the shape of the projection within the pattern and eliminate excessive electroforming portions, thereby realizing the ink-jet printers with high resolution and increasing the production rate.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A method of controlling excessive electroforming portion of an oscillating plate for an ink-jet printer comprising steps of:

supplying a direct current power to electroform a first layer for a first time period;

supplying an alternating current power to electroform a second layer on said first layer for a second time period to form an oscillating plate;

coating said second layer with a photoresistive agent at positions where no projection is to be formed; and supplying said alternating current power to electroform for a third time period so as to form desired projections on said second layer.

2. The method of controlling excessive electroforming portion of an oscillating plate for an ink-jet printer as claimed in claim 1, wherein said direct current power has a voltage of −4.5 volts.

3. The method of controlling excessive electroforming portion of an oscillating plate for an ink-jet printer as claimed in claim 1, wherein said first time period is 1 minute.

4. The method of controlling excessive electroforming portion of an oscillating plate for an ink-jet printer as claimed in claim 1, wherein said alternating current are square waves with an amplitude of ±4.5 volts.

5. The method of controlling excessive electroforming portion of an oscillating plate for an ink-jet printer as claimed in claim 4, wherein said square waves have an electroforming term at −4.5 volts for 90 ms and an electrolyzing term at +4.5 volts for 300–600 ms.

6. The method of controlling excessive electroforming portion of an oscillating plate for an ink-jet printer as claimed in claim 1, wherein said second time period is 3 minutes.

7. The method of controlling excessive electroforming portion of an oscillating plate for an ink-jet printer as claimed in claim 1, wherein said oscillating plate is made of nickel.

8. The method of controlling excessive electroforming portion of an oscillating plate for an ink-jet printer as claimed in claim 1, wherein said third time period is 25–40 minutes.

* * * * *